US005976278A

United States Patent [19]

Sircar

[11] Patent Number: 5,976,278

[45] Date of Patent: Nov. 2, 1999

[54] CORROSION RESISTANT, DRAWABLE AND BENDABLE ALUMINUM ALLOY, PROCESS OF MAKING ALUMINUM ALLOY ARTICLE AND ARTICLE

[75] Inventor: Subhasish Sircar, Richmond, Va.

[73] Assignee: Reynolds Metals Company, Richmond, Va.

[21] Appl. No.: 08/943,256

[22] Filed: Oct. 3, 1997

[51] Int. Cl.[6] ..... C22F 1/04; C22C 21/04

[52] U.S. Cl. ..... 148/550; 148/437; 420/552

[58] Field of Search ..... 148/550, 437; 420/532

[56] References Cited

U.S. PATENT DOCUMENTS

| | | | |
|---|---|---|---|
| 3,878,871 | 4/1975 | Anthony et al. . | |
| 4,649,087 | 3/1987 | Scott et al. . | |
| 4,828,794 | 5/1989 | Scott et al. . | |
| 5,125,452 | 6/1992 | Yamauchi et al. . | |
| 5,286,316 | 2/1994 | Wade . | |
| 5,503,690 | 4/1996 | Wade et al. | 148/550 |

OTHER PUBLICATIONS

"Standard Practice for Modified Salt Spray (Fog) Testing", American Society for Testing and Materials, Designation: G 85 –94 , pp. 350–355, Apr. 1994.

J.R. Galvele et al., "Mechanism of Intergranular corrosion of A1–Cu Alloys", pp. 795–807, presented at the 4th International Congress on Metallic Corrosion, Amsterdam, Sep. 7–14, 1969.

Ahmed, "Designing of an Optimum Aluminium Alloy for De–salination Applications", pp. 255–261, *Strength of Metals and Alloys*, vol. 1, Proceedings of the 6th International Conference Melbourne, Australia, Aug. 16–20, 1982.

I.L. Muller et al., Pitting Potential of High Purity Binary Aluminium Alloys –1; pp. 180–183, 186–193, 1977.

*Primary Examiner*—Melvyn Andrews
*Attorney, Agent, or Firm*—Alan M. Biddison

[57] ABSTRACT

An aluminum-based alloy composition having improved combinations of corrosion resistance, drawability, bendability and extrudability consists essentially of, in weight percent, not more than about 0.03% copper, between about 0.1 and up to about 1.5% manganese, between about 0.03 and about 0.35% titanium, an amount of magnesium up to about 1.0%, less than 0.01% nickel, between about 0.06 and about 1.0% zinc, an amount of zirconium up to about 0.3%, amounts of iron and silicon up to about 0.50%, up to 0.20% chromium, with the balance aluminum and inevitable impurities. A process of making an aluminum alloy article having high corrosion resistance, drawability, bendability and hot deformability is also provided.

28 Claims, 5 Drawing Sheets

| # | Mn | UTS | YS | Elong | Elong / 5 | (rel n) * 20 |
|---|---|---|---|---|---|---|
| X3030 | 0.23 | 10.9 | 8.1 | 35.5 | 7.10 | 6.91 |
| A | 0.5 | 13.2 | 8.3 | 36.5 | 7.30 | 11.81 |
| B | 0.8 | 14.1 | 9.0 | 36.5 | 7.30 | 11.33 |
| C | 1.2 | 17.2 | 11.4 | 42.5 | 8.50 | 10.18 |

| # | Mn | UTS | YS | Elong | Elong / 5 | (rel n) * 20 |
|---|---|---|---|---|---|---|
| X3030 | 0.23 | 10.9 | 8.1 | 35.5 | 7.10 | 6.91 |
| A | 0.5 | 13.2 | 8.3 | 36.5 | 7.30 | 11.81 |
| B | 0.8 | 14.1 | 9.0 | 36.5 | 7.30 | 11.33 |
| C | 1.2 | 17.2 | 11.4 | 42.5 | 8.50 | 10.18 |

Mn = 0.23

| # | Zr | UTS | YS | Elong | Elong / 5 | (rel n) * 20 |
|---|---|---|---|---|---|---|
| X3030 | 0.0 | 10.9 | 8.1 | 35.5 | 7.10 | 6.91 |
| D | 0.1 | 12.2 | 8.4 | 41.5 | 8.30 | 9.05 |
| E | 0.2 | 12.1 | 8.1 | 36.0 | 7.20 | 9.88 |

Mn = 0.23

| # | Mg | UTS | YS | Elong | Elong / 5 | (rel n) * 20 |
|---|---|---|---|---|---|---|
| X3030 | 0.0 | 10.9 | 8.1 | 35.5 | 7.10 | 6.91 |
| L | 0.3 | 14.5 | 8.7 | 40.5 | 8.10 | 13.33 |
| M | 0.6 | 16.7 | 9.8 | 35.0 | 7.00 | 14.08 |

Mn = 0.5
Mg = 0.3

| # | Zr | UTS | YS | Elong | Elong / 5 | (rel n) * 20 |
|---|---|---|---|---|---|---|
| N | 0.0 | 15.2 | 8.7 | 36.5 | 7.30 | 14.94 |
| T | 0.1 | 15.7 | 9.6 | 35.5 | 7.10 | 12.71 |
| V | 0.2 | 15.9 | 9.1 | 39.0 | 7.80 | 14.95 |

Mn = 0.8
Mg = 0.3

| # | Zr | UTS | YS | Elong | Elong / 5 | (rel n) * 20 |
|---|---|---|---|---|---|---|
| O | 0.0 | 16.9 | 10.8 | 37.0 | 7.40 | 11.30 |
| U | 0.1 | 17.4 | 11.1 | 36.5 | 7.30 | 11.35 |
| W | 0.2 | 17.1 | 10.5 | 35.5 | 7.10 | 12.57 |

CORROSION RESISTANT, DRAWABLE AND BENDABLE ALUMINUM ALLOY, PROCESS OF MAKING ALUMINUM ALLOY ARTICLE AND ARTICLE

FIELD OF THE INVENTION

The present invention is directed to a corrosion resistant aluminum alloy and, in particular, to an AA3000 series type aluminum alloy including controlled amounts of one or more of manganese, magnesium and zirconium for improved drawability.

BACKGROUND ART

In the prior art, aluminum is well recognized for its corrosion resistance. AA1000 series aluminum alloys are often selected where corrosion resistance is needed.

In applications were higher strengths may be needed, AA1000 series alloys have been replaced with more highly alloyed materials such as the AA3000 series type aluminum alloys. AA3102 and AA3003 are examples of higher strength aluminum alloys having good corrosion resistance.

Aluminum alloys of the AA3000 series type have found extensive use in the automotive industry due to their combination of high strength, light weight, corrosion resistance and extrudability. These alloys are often made into tubing for use in heat exchanger or air conditioning condenser applications.

One of the problems that AA3000 series alloys have when subjected to some corrosive environments is pitting or blistering corrosion. These types of corrosion often occur in the types of environments found in heat exchanger or air conditioning condenser applications and can result in failure of an automotive component where the corrosion compromises the integrity of the aluminum alloy tubing.

In a search for aluminum alloys having improved corrosion resistance, more highly alloyed materials have been developed such as those disclosed in U.S. Pat. Nos. 4,649,087 and 4,828,794. These more highly alloyed materials while providing improved corrosion performance are not conducive to extrusion due to the need for extremely high extrusion forces.

U.S. Pat. No. 5,286,316 discloses an aluminum alloy with both high extrudability and high corrosion resistance. This alloy consists essentially of about 0.1–0.5% by weight of manganese, about 0.05–0.12% by weight of silicon, about 0.10–0.20% by weight of titanium, about 0.15–0.25% by weight of iron, with the balance aluminum and incidental impurities. The alloy preferably is essentially copper free, with copper being limited to not more than 0.01%. This alloy is essentially copper free with the level of copper not exceeding 0.03% by weight.

Although the alloy disclosed in U.S. Pat. No. 5,286,316 offers improved corrosion resistance over AA3102, even more corrosion resistance is desirable. In corrosion testing using salt water—acetic acid sprays as set forth in ASTM Standard G85 (hereinafter SWAAT testing), condenser tubes made of AA3102 material lasted only eight days in a SWAAT test environment before failing. In similar experiments using the alloy taught in U.S. Pat. No. 5,286,316, longer durations than AA3102 were achieved. However, the improved alloy of U.S. Pat. No. 5,286,316 still failed in SWAAT testing in less than 20 days.

An improved aluminum alloy has been developed which overcomes the drawbacks noted above in prior art corrosion resistant alloys. This improved alloy is an AA3000 series type alloy having controlled amounts of copper, zinc and titanium. The improved alloy is especially suited for applications requiring both hot formability and corrosion resistance. The alloy consists essentially of, in weight percent, an amount of copper up to 0.03%, between about 0.05 and 0.12% silicon, between about 0.1 and about 0.5% manganese, between about 0.03 and about 0.30% titanium, less than 0.01% magnesium, less than 0.01% nickel, between about 0.06 and about 1.0% zinc, an amount of iron up to about 0.50%, up to 0.50% chromium, with the balance aluminum and inevitable impurities. Further, an example of the alloy is described in which the copper is about 0.008% or less; the titanium is between about 0.07 and 0.20%; the zinc is between about 0.10 and 0.20%; and iron is between about 0.05 and 0.30%. This improved alloy is disclosed in U.S. patent application Ser. No. 08/659,787 filed on Jun. 6, 1996, which is hereby incorporated in its entirety by reference.

While the improved alloy offers superb corrosion resistance and hot formability, particularly when extruded into tubing, the improved alloy does not always provide adequate performance when subjected to further cold deforming and optional annealing. Often times, the improved alloy is cold drawn after hot deforming or cold drawn and annealed. The cold drawn alloy is susceptible to necking or local deformation which can cause product breakage and an unacceptable surface finish, e.g. stretcher strains or orange peel. One of the causes of the necking is insufficient resistance to deformation or softness once the material passes the yield point but has not reached the ultimate tensile strength. In the metallurgical arts, the ability to resist local deformation can be measured by the "n value". The n value generally measures the difference between the yield point and the ultimate tensile strength. Since this value is well recognized in the art, a further description is not deemed necessary for understanding of the invention In view of the drawbacks of the improved alloy discussed above, a need has developed to provide a new and improved alloy which has not only good corrosion resistance and hot formability but also bendability and drawability. In response to this need, the present invention provides an aluminum alloy material which has controlled amounts of manganese, magnesium and zirconium and is suitable for not only corrosion resistant applications of hot deformed materials but also materials that are hot deformed and cold worked, with or without annealing and subsequent cold deforming.

SUMMARY OF THE INVENTION

Accordingly, it is a first object of the present invention to provide an aluminum alloy having improved combinations of corrosion resistance and hot formability.

Another object of the present invention is to provide an aluminum alloy which includes manageable levels of copper to facilitate manufacturing.

A still further object of the present invention is to provide an aluminum alloy which has both hot formability, corrosion resistance, drawability and bendability.

Another object of the present invention is to provide an extrusion, particularly, extruded condenser tubing, having improved combinations of corrosion resistance, drawability and good hot formability.

Other objects and advantages of the present invention will become apparent as a description thereof proceeds.

In satisfaction of the foregoing objects and advantages, the present invention provides a corrosion resistant aluminum alloy consisting essentially of, in weight percent, not more than 0.03% copper, between about 0.1 and up to about 1.5% manganese, between about 0.03 and about 0.35% titanium, an amount of magnesium up to about 1.0%, less than 0.01% nickel, between about 0.06 and about 1.0% zinc, an amount of zirconium up to about 0.3%, amounts of iron and silicon up to about 0.50%, up to 0.50% chromium with the balance aluminum and inevitable impurities.

More preferably, the copper is about 0.02% or less, the titanium is between about 0.12 and 0.20%, the zinc is between about 0.10 and 0.20% and iron is between about 0.05 and 0.30%. Preferred amounts of manganese, magnesium and zirconium include between about 0.3 and 1.0% Mn, about 0.2 and 0.8% Mg and about 0.01 and 0.15% Zr.

Considering in more detail the amounts of the individual components, copper preferably is not more than 0.006%, more preferably, not more than 0.004%. Silicon is preferably between 0.05 and 0.1%, more preferably, not more than 0.06%. Manganese is preferably between 0.5 and 1.1%, more preferably, not more than 0.8%. The preferred amount of magnesium is highly dependent on the intended use of the article because magnesium impacts extrudability, especially with thin sections. With applications with these types of requirements, magnesium is preferably less than 0.2%, more preferably less than 0.1%. Magnesium is believed to adversely impact brazeability with some types of brazing operations. Products intended for use in these applications must have the amount of magnesium controlled to less than 0.2%. Magnesium, on the other hand, improves the control of grain size which impacts formability, especially in thicker sections. With these types of applications, magnesium levels of 0.2%, 0.3% or higher could be desired. Zinc is preferably in the range of 0.14 to 0.18%, more preferably not more than 0.15%. Titanium is preferably in the range of 0.14 to 0.18%, with not more than 0.16% being more preferred. Zirconium is preferably less than 0.01%. Iron is preferably less than 0.07%. Both nickel and chromium are preferably less than 0.02%, with amounts of less than 0.01% being more preferred.

The inventive corrosion resistant aluminum alloy provides improved corrosion resistance over known AA3000 series type alloys. Consequently, the inventive aluminum alloy exhibits both good corrosion resistance and hot formability. In addition, by controlling the manganese, magnesium and zirconium contents, the inventive alloy can also be cold worked or cold worked and annealed without localized deformation or impairment of the product surface during working operations, such as drawing and bending.

The inventive alloy can be made by casting the alloy composition, homogenizing the cast product, cooling, reheating and hot deforming. The hot deformed product can be used in its hot worked condition or it can be cold worked or cold worked and annealed depending on the desired end product application. Preferably, the hot deforming is extruding and the cold deforming is drawing and/or bending. The inventive method produces a hot deformed product or an intermediate product for subsequent cold deforming.

BRIEF DESCRIPTION OF THE DRAWINGS

Reference is now made to the drawings of the invention wherein.

DESCRIPTION OF THE PREFERRED EMBODIMENTS

Figure 1:
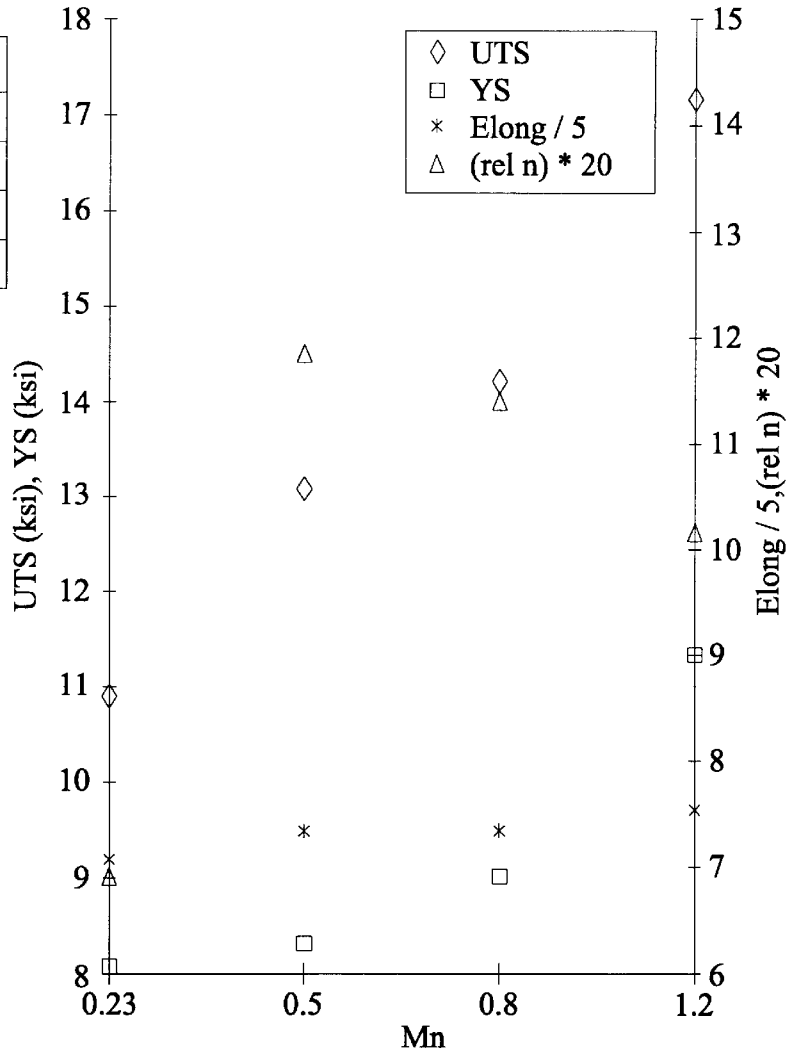
FIG. 1 relates yield strength (YS), ultimate tensile strength (UTS), elongation, and relative n value (rel. n) to a prior art aluminum alloy and the effect on manganese thereon.

The present invention provides an aluminum alloy having significantly improved bendability or drawability over the prior art alloys. As set forth above, the previously known AA3000 series type alloys which exhibit good corrosion resistance and extrudability are prone to local deformation or necking when hot deformed, cold deformed, and/or annealed, particularly in environments wherein the alloys are manufactured into condenser tubing for heat exchanger or air conditioning applications. These aluminum alloys also exhibit poor surface finish and product breakage after cold deformation. The inventive alloy composition, through control of the alloying elements thereof, provides vastly improved bendability and drawability while still maintaining acceptable levels of hot formability, mechanical properties and corrosion resistance.

In its broadest sense, the present invention provides an aluminum alloy consisting essentially of, in weight percent, not more than about 0.03% of copper, between about 0.1 and up to about 1.2% or 1.5% manganese, between about 0.03 and about 0.35% titanium, an amount of magnesium up to about 1.0%, less than 0.01% nickel, between about 0.05 and about 1.0% zinc, an amount of zirconium up to about 0.3%, amounts of iron and silicon up to about 0.50%, up to 0.20% chromium, with the balance aluminum and inevitable impurities.

Preferably, the copper content is held to less than about 0.01%. The titanium percent is preferably maintained between about 0.07 and 0.20%. The zinc amount is maintained between about 0.06 and 1.0%.

More preferably, the zinc content is maintained between about 0.06 and 0.5%, even more preferably between about 0.10% an 0.20%. The titanium is between about 0.12 and 0.20% and iron and silicon are between about 0.05 and 0.30%. Preferred amounts of manganese, magnesium and zirconium include between about 0.3 and 0.15% Mn, about 0.2 and 0.8% Mg and about 0.05 and 0.15% zirconium. If so desired, one or two of the group of manganese, magnesium or zirconium could be eliminated while improving drawability as evidenced by the study discussed below.

To demonstrate the improved drawability and bendability of the inventive aluminum alloy composition, a study was conducted using a series of alloy compositions, with varying amounts of manganese, magnesium and zirconium. The alloy composition used as the control for the study was X3030 (composition, in weight %: Si—0.15% max, Fe—0.35% max, Cu—0.10% max, Mn—0.10 to 0.7%, Mg—0.05% max, Cr—0.05% max, Ni—impurity, Zn—0.05 to 0.50%, Ti—0.05 to 0.35%, others—0.05 each, 0.15 total, balance aluminum). For instance, manganese levels varied between 0.5%, 0.8%, and 1.2%. Magnesium levels varied between 0.3% and 0.6%. The zirconium targets included 0.10% and 0.20%.

It is believed that the combination of one or more of zirconium, manganese and magnesium with the improved aluminum alloy described above overcomes the poor strength and large grain size which are typical of the control alloy. These alloying elements are believed to contribute to the improved mechanical properties of the inventive alloy, i.e., increased strength, a finer grain size or more inhibition to grain growth/recrystallization.

The study was conducted to investigate mechanical properties in the hot deformed condition and in the hot deformed, cold deformed, reheated and quenched condition. The first testing using just hot deformation was intended to be representative of processing such as extrusion or the like. The second testing combining hot deforming, cooling, cold working, reheating and quenching was intended to simulate commercial processing wherein the extruded or hot deformed product would be subjected to further cold working, heating and quenching. In the first testing, the alloy composition was selected, cast into a 3" (76.2 mm)×8" (203.2 mm)×15" (381 mm) ingot and scalped. The ingot was conventionally homogenized, cooled and hot rolled to ⅜" (9.5 mm) thickness and subjected to tensile testing. In the second testing, the hot rolled material was air cooled, then cold worked, reheated to 1000° F. (538° C.), held for 1 hour and water quenched Representative results of the first testing are illustrated in FIGS. 1–5 in terms of YS and UTS (KSI), elongation, and rel. n value. Rel. n is calculated as (UTS-YS)/YS to simulate actual n values for comparison purposes.

FIG. 1 demonstrates that the addition of manganese provides significant improvements in rel. n values over the prior art X3030 aluminum alloy. Improvements are also realized in ultimate tensile strength and, quite surprisingly, without any significant compromise in elongation. Both elongation and rel. n values have been multiplied by scaling factors for graphing purposes.

Figure 2:
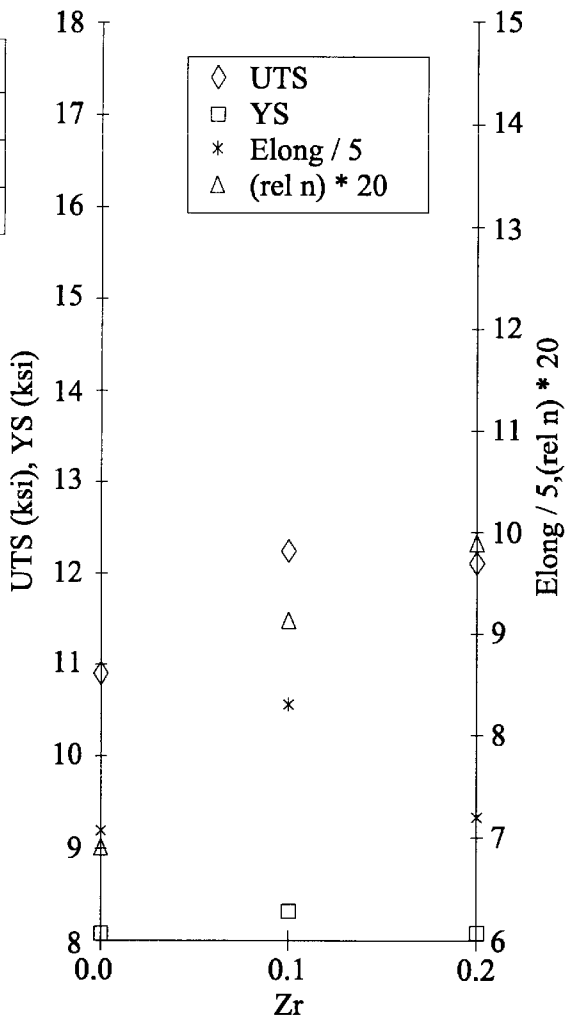
FIG. 2 is a graph similar to FIG. 1 wherein the effect of magnesium on the prior art aluminum alloy is illustrated.

FIG. 2 also demonstrates that increases are obtained in rel. n value when zirconium is added to the prior art X3030 alloy. Again, no compromise is seen in elongation or yield strength, even though there is an increase in ultimate tensile strength.

Figure 3:
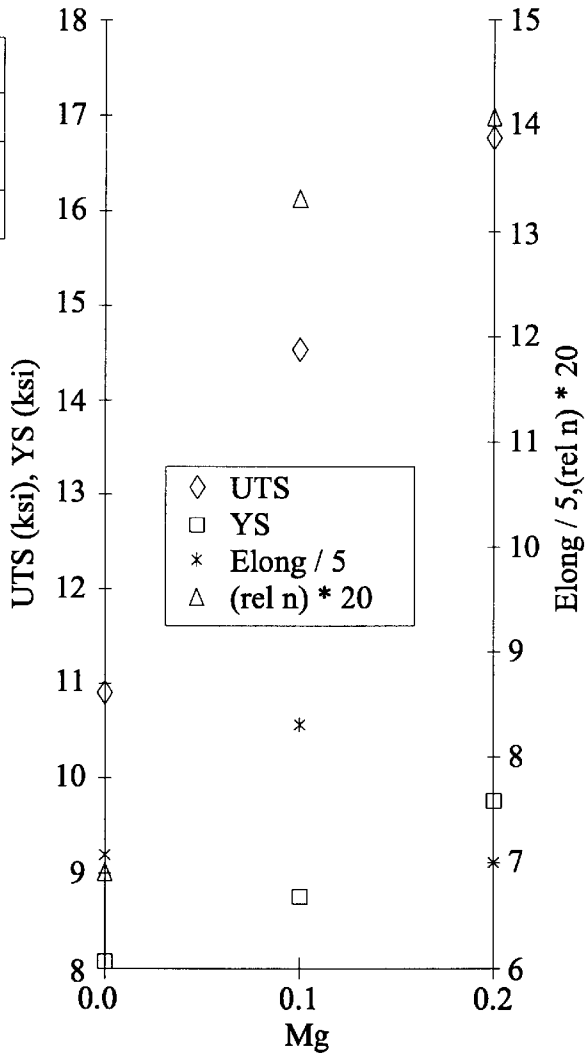
FIG. 3 shows the effect of zirconium on the prior art aluminum alloy with respect to YS, UTS, elongation and rel. n value.

Similar to the results with increasing the manganese and zirconium, FIG. 3 shows that magnesium also contributes to improved rel. n and UTS values without compromising elongation.

Figure 4:
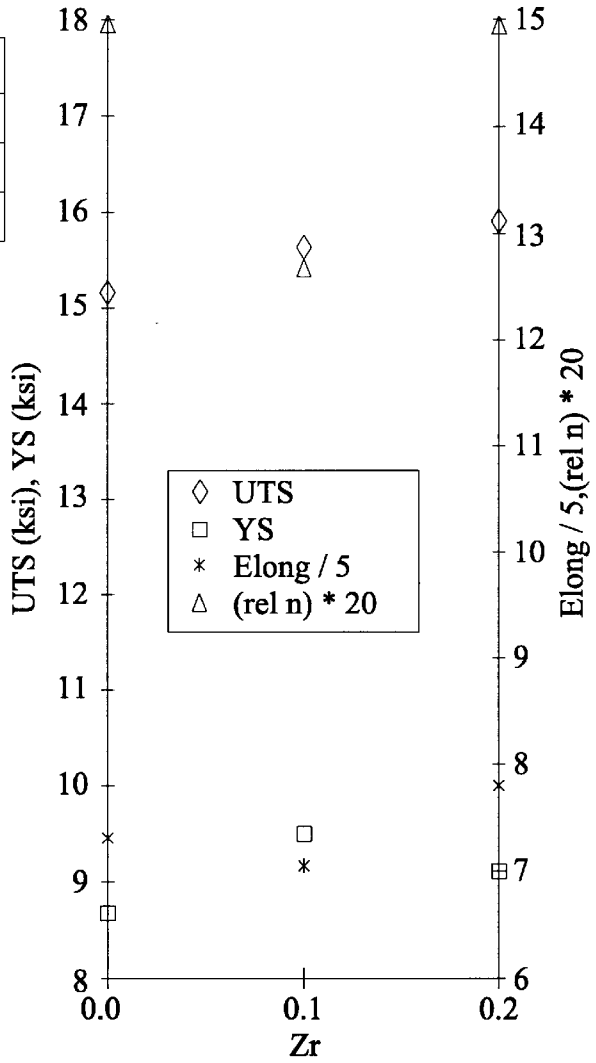
FIGS. 4 and 5 relate YS, UTS, elongation, and rel. n values for two zirconium-manganese-magnesium containing aluminum alloys.
Figure 5:
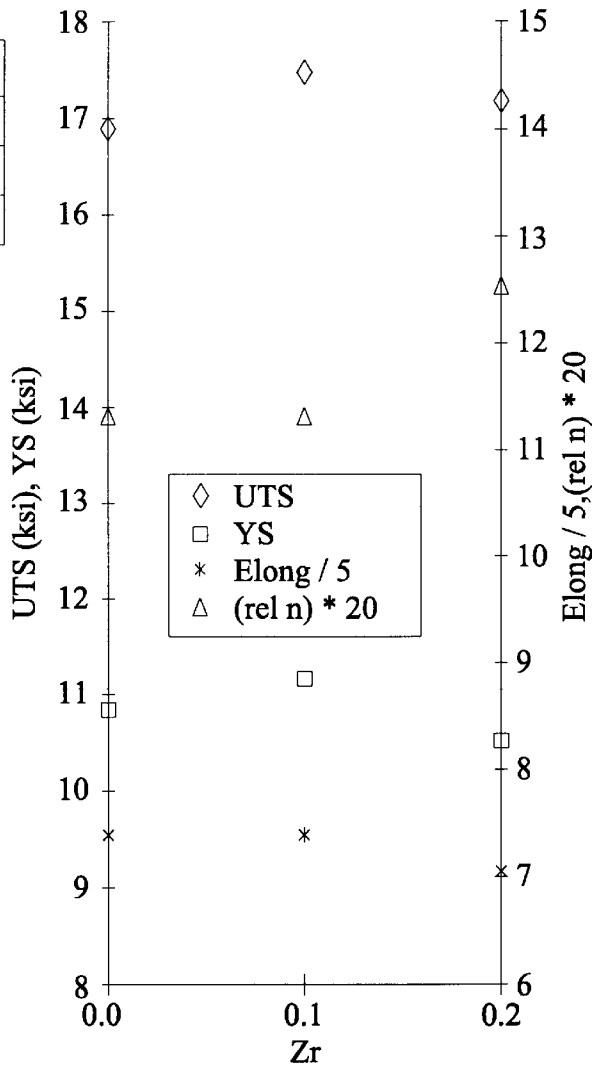

FIGS. 4 and 5 show the effect of combining zirconium, manganese and magnesium, wherein the manganese varies from 0.5% to 0.8%. When comparing the rel. n values in FIGS. 4 and 5 for the exemplified compositions with the rel. n value shown in FIGS. 1–3 for X3030, vastly improved rel. n values are achieved, particularly, for the composition exemplified in FIG. 4. These rel. n values are even improved over the values when just manganese or zirconium is added. Again, no compromise is seen in elongation and the strength values are also exceptional.

The results demonstrated in FIGS. 1–5 indicate that the inventive alloy composition, when containing levels of zirconium, manganese and magnesium as described above, provides significant improvements in drawability. Thus, this alloy composition can be extruded and then cold worked without localized deformation or necking. Annealing, after a significant amount of cold work also does not cause severe grain growth and hence this alloy is also suitable for use in applications that require cold work and annealing. Factors contributing to this unexpected result include the higher rel. n values, the improved strength values and the finer grain size present in the hot worked structure. As discussed below, the fine grain structure of the inventive alloy composition remains even after the composition has been annealed. Thus, an article having the inventive composition which is hot deformed, cold deformed and subsequently annealed will have an improved surface structure and higher yield. More specifically, the inventive alloy composition, by reason of its improved drawability, removes or eliminates stretcher strains and orange peel when the deformed article is subjected to subsequent cold working, such as stretching, bending, drawing and the like. In addition, because of the improved drawability of the article, product breakage during processing is reduced or eliminated, thereby improving yields in productivity.

Tables 1 and 2 exemplify the second testing performed with the alloy composition. As stated above, in this testing, the hot deformed material was subjected to reheating and water quenching to investigate the effects of these operations on both n value and mechanical properties. As is evident from Tables 1 and 2, the prior art X3030 alloy does not provide desirable mechanical properties in terms of strength or n value. Comparing these values to the inventive alloy compositions A–W, significant improvements in n value and strengths are realized, see for example, alloys A–C containing magnesium; alloy T containing magnesium, manganese and zirconium; and alloys J and N containing manganese and zirconium and magnesium and manganese, respectively. Overall, the inventive alloy compositions A–W provide considerable improvement in both n value and the mechanical properties of ultimate tensile strength, yield strength and elongation.

The results of Tables 1 and 2 also indicate that subsequent annealing of the hot deformed structure does not adversely affect the mechanical properties. Consequently, an article having the inventive alloy composition, when cold worked and annealed will still exhibit vastly improved mechanical properties over an X3030 prior art alloy. Again, stretcher strains and orange peel will be reduced and/or eliminated as will product breakage.

A micrograph comparison was made between an X3030 alloy and an alloy of the invention containing roughly 0.6% magnesium and 1.2% manganese. The comparison was done along a longitudinal section of an extruded tubing after annealing. Even after subjecting the extruded article to annealing, the overall grain size of the article was significantly finer than with the prior art X3030 article. This finer grain size permits the article to be uniformly cold deformed without local deformation or necking.

Besides having improved bendability or drawability, the inventive alloy article also exhibits the same corrosion resistance as the prior art X3030 alloy, when hot deformed. Consequently, no compromise in corrosion resistance is made by adding the controlled amounts of manganese, magnesium and zirconium. Thus, the inventive alloy still has the same capabilities in terms of corrosion resistance as the prior art X3030 alloy. The results are shown in Table 3 wherein alloys A to W and X3030, after hot rolling, were subjected to corrosion testing in accordance with ASTM G85, Annex 3 (Salt Water Acetic Acid Test or SWAAT), for 19 days.

In an effort to demonstrate that the inventive aluminum based alloy has similar corrosion resistance as the prior X3030 alloy, corrosion resistance testing was performed according to ASTM G85, Annex 3 standards. In this testing, tubing is manufactured and subjected to a corrosion resistance testing procedure using a cyclical salt-water acetic acid spray test, hereinafter referred to as SWAAT testing. In this testing, specimens of each tubing are cut to 6 or 12 inch lengths and exposed to the hostile environment mentioned above for a specified period of time. After a specified exposure interval, specimens are cleaned in an acid solution to remove the corrosion products and visually inspected for corrosion. In Table 3, the visual observations of the X3030 alloy and inventive alloy compositions A to W are shown. The exposure during SWAAT testing was for 19 days. Overall, the corrosion of inventive alloys A to W paralleled the uniform etching attack of the prior art X3030 alloy. Consequently, no compromise is seen in corrosion resistance when modifying the X3030 alloy according to the invention for improved drawability.

In making the inventive alloy, the alloy can be cast, homogenized and cooled as is well known in the art. Following cooling, the alloy can be hot deformed, e.g. extruded into any desired shape. The hot deformed alloy can then be further cold worked, e.g., drawn, bent or the like. Annealing can be done if a need exists to soften the material for further cold work, e.g. flaring or bending an extruded and cold drawn tube. The inventive alloy is also believed to be useful in any application which requires good corrosion resistance and hot deformability with cold formability such as drawing, bending, flaring or the like. Quite surprisingly, the inventive alloy and method combines the ability to have not only corrosion resistance and hot deformability but also sufficient mechanical properties, e.g. YS, UTS and n values, to make the product especially adapted for applications where it is extruded, fast quenched, cold formed and annealed. The inventive alloy is particularly adapted for use as tubing, e.g., a condenser tube having either a corrugated or smooth inner surface, multivoid tubing, or as inlet and outlet tubes for heat exchangers such as condensers. In other examples, the composition may be used to produce fin stock for heat exchangers, corrosion resistant foil for packaging applications subjected to corrosion from salt water and other extruded articles or any other article needing corrosion resistance.

As such, an invention has been disclosed in terms of preferred embodiments thereof which fulfill each and every one of the objects of the present invention as set forth above and provides a new and improved aluminum based alloy composition having an improved combination of corrosion resistance, extrudability and drawability, and a method of making the same.

Of course, various changes, modifications and alterations from the teachings of the present invention may be contemplated by those skilled in the art without departing from the intended spirit and scope thereof. It is intended that the present invention only be limited by the terms of the appended claims.

TABLE 1

| Alloy Des. | Mn, Mg, Zr Amounts | n value | UTS (KSI) | YS (KSI) | ELONG. % |
|---|---|---|---|---|---|
| X3030 | 0.23 Mn, 0.02 Zr <0.01 Mg | 0.225 | 8.7 | 4.4 | 44.0 |
| A | 0.5 Mn | 0.285 | 11.1 | 5.1 | 45.5 |
| B | 0.8 Mn | 0.265 | 11.5 | 5.2 | 49.5 |
| C | 1.2 Mn | 0.347 | 14.5 | 6.2 | 46.0 |
| D | 0.1 Zr | 0.229 | 9.7 | 4.6 | 55.0 |
| E | 0.2 Zr | 0.242 | 9.9 | 4.7 | 45.5 |
| F | 0.5 Mn, 0.1 Zr | 0.260 | 10.9 | 4.8 | 51.0 |
| G | 0.5 Mn, 0.2 Zr | 0.256 | 10.9 | 5.0 | 47.0 |
| H | 0.8 Mn, 0.1 Zr | 0.244 | 12.5 | 5.9 | 44.0 |
| I | 0.8 Mn, 0.2 Zr | 0.250 | 12.8 | 5.9 | 45.0 |
| J | 1.2 Mn, 0.1 Zr | 0.313 | 14.2 | 6.1 | 40.0 |
| K | 1.2 Mn, 0.2 Zr | 0.283 | 14.0 | 6.1 | 46.5 |
| L | 0.3 Mg | 0.430 | 12.3 | 5.2 | 44.5 |
| M | 0.6 Mg | 0.240 | 14.8 | 6.6 | 42.5 |
| N | 0.3 Mg, 0.5 Mn | 0.282 | 14.0 | 6.2 | 41.5 |

TABLE 1-continued

| Alloy Des. | Mn, Mg, Zr Amounts | n value | UTS (KSI) | YS (KSI) | ELONG. % |
|---|---|---|---|---|---|
| O | 0.3 Mg, 0.8 Mn | 0.276 | 14.5 | 6.2 | 41.0 |
| P | 0.3 Mg, 1.2 Mn | 0.281 | 17.0 | 7.7 | 41.0 |
| Q | 0.6 Mg, 0.5 Mn | 0.298 | 16.1 | 7.0 | 37.0 |
| R | 0.6 Mg, 1.2 Mn | 0.299 | 17.7 | 8.8 | 38.0 |
| S | 0.6 Mg, 1.2 Mn | 0.261 | 20.0 | 5.7 | 33.5 |
| T | 0.3 Mg, 0.8 Mn 0.1 Zr | 0.287 | 13.4 | 5.7 | 40.5 |
| U | 0.3 Mg, 0.5 Mn 0.1 Zr | 0.220 | 15.0 | 7.5 | 45.5 |
| V | 0.3 Mg, 0.5 Mn 0.2 Zr | 0.217 | 13.7 | 7.0 | 46.0 |
| W | 0.3 Mg, 0.8 Mn 0.2 Zr | 0.215 | 15.7 | 7.9 | 40.5 |

TABLE 2

| Alloy Designation | UTS (KSI) | YS (KSI) | ELONG. % | UTS-YS / YS |
|---|---|---|---|---|
| X3030 | 10.9 | 8.1 | 35.5 | 0.35 |
| A | 13.2 | 8.3 | 36.5 | 0.59 |
| B | 14.1 | 9.0 | 36.5 | 0.57 |
| C | 17.2 | 11.4 | 42.5 | 0.51 |
| D | 12.2 | 8.4 | 41.5 | 0.45 |
| E | 12.1 | 8.1 | 36.0 | 0.49 |
| F | 13.4 | 8.9 | 42.0 | 0.51 |
| G | 13.7 | 9.0 | 39.0 | 0.52 |
| H | 14.6 | 9.5 | 38.5 | 0.54 |
| I | 13.8 | 8.7 | 40.0 | 0.59 |
| J | 15.9 | 9.6 | 40.0 | 0.66 |
| K | 15.8 | 9.8 | 38.0 | 0.61 |
| L | 14.5 | 8.7 | 40.5 | 0.67 |
| M | 16.7 | 9.8 | 35.0 | 0.70 |
| N | 15.2 | 8.7 | 36.5 | 0.75 |
| O | 16.9 | 10.8 | 37.0 | 0.56 |
| P | 19.0 | 11.7 | 33.5 | 0.62 |
| Q | 17.8 | 10.7 | 35.0 | 0.66 |
| R | 19.5 | 11.8 | 32.5 | 0.65 |
| S | 21.7 | 12.7 | 31.5 | 0.71 |
| T | 15.7 | 9.6 | 35.5 | 0.64 |
| U | 17.4 | 11.1 | 36.5 | 0.57 |
| V | 15.9 | 9.1 | 39.0 | 0.75 |
| W | 17.1 | 10.5 | 35.5 | 0.63 |

TABLE 3

| ALLOY | Observations |
|---|---|
| X3030 | Uniform etching attack, large grains, and some moderate flat bottomed pits. |
| A | Uniform etching attack, large grains, and a few small flat bottomed pits. |
| B | Uniform etching attack, large grains, and a few small flat bottomed pits. |
| C | Uniform etching attack, very small grains, looks very nice. |
| D | Uniform etching attack, larger grains, looks like some of the grains fell out during testing/cleaning. |
| E | Uniform etching attack, larger grains, and some tiny round blisters spread out across the sample. |
| F | Uniform etching attack with no significant pitting. Medium size grains. |
| G | Uniform pitting, larger grains, and a couple of strange looking pits (deep with brown discoloration) |
| H | Uniform etching attack, 2–3 small blisters, and medium grains. |
| I | Uniform pitting, small blisters, and a few grains gone that fell out during testing/cleaning. |
| J | Uniform etching attack, small grains, looks nice. |
| K | Uniform etching attack, small grains, very small blisters across one side of the sample. |
| L | Many tiny occluded pits which look like round blisters. Some |

TABLE 3-continued

| ALLOY | Observations |
|---|---|
| | deep pits. |
| M | Uniform etching attack with a few small pits. Areas where grains appear to have fallen out. |
| N | Uniform pitting, small blisters, and a few grains gone that fell out during testing/cleaning. |
| O | Uniform etching attack, 1–3 small blisters/side, light flat bottomed pitting. |
| P | Uniform etching attack with some tiny individual pits and a few very small blisters. |
| Q | Uniform etching attack with a couple of very small pits . . . it looks very nice. |
| R | Uniform etching attack with a few small pits. Areas where grains appear to have fallen out. |
| S | Uniform etching attack, beautiful, with very small grains. |
| T | Uniform etching attack with pitting. It almost looks like groups of grains have fallen out. |
| U | Uniform etching attack, the 2 sides were different, small grains, 2–4 blisters on 1 side. |
| V | Uniform etching attack with no significant pitting. Medium size grains. |
| W | Uniform etching attack with a few small flat bottomed pits, Couple of small blisters. |
| | SWAAT Exposure for 19 days Conducted per ASTM Standard G85, Annex 3 |

What is claimed is:

1. A corrosion resistant and drawable aluminum alloy consisting essentially of in weight percent:

a) not more than 0.03% copper, b) between about 0.05 and 0,50% silicon;

c) between about 0.1 and 1.5% manganese;

d) between about 0.03 and 0.35% titanium;

e) between 0.06 and about 1.0% zinc;

f) up to about 1.0% magnesium;

g) an amount of iron up to 0.50%;

h) less than 0.01% nickel;

i) up to 0.5% chromium; and j) up to about 0.3% zirconium;

with the balance aluminum and incidental impurities.

2. The alloy of claim 1 wherein copper is less than about 0.02%, titanium is between about 0.07 and 0.20%, zinc is between about 0.10 and 1.0% and iron is between about 0.05 and 0.30%.

3. The alloy of claim 2 wherein the aluminum alloy includes amounts of magnesium and zirconium.

4. The alloy of claim 1 wherein the manganese ranges between about 0.3 and 1.0%, the magnesium ranges between about 0.2 and 0.6% and the zirconium ranges between about 0.05 and 0.15%.

5. The alloy of claim 4 wherein manganese ranges between about 0.5 to 0.8%, magnesium ranges between 0.3 and 0.6% and zirconium ranges between about 0.08 and 0.12%.

6. The alloy of claim 1 wherein manganese ranges between about 0.3 and 1.0%.

7. The alloy of claim 1 wherein the amounts of magnesium and zinc each ranges between about 0.2 and 0.8%.

8. An extrudate having the composition of the aluminum alloy of claim 1.

9. The extrudate of claim 8 in the form of a tubing.

10. A cold worked article having the composition of claim 1.

11. A cold worked and subsequently annealed article having the composition of claim 1.

12. A process of making an aluminum alloy article having high corrosion resistance, said process comprising:

a) casting a workpiece having a composition consisting essentially of, in weight percent, about 0.1 to 1.2% of manganese, about 0.05 to 0.12% of silicon, about 0.03 to 30 of titanium, not more than 0.03% by weight of copper, an amount of iron up to 0.30%, between 0.06 and about 1.0% zinc, up to about 0.8% magnesium, less than 0.01% nickel, to 0.5% chromium, up to about 0.2% zirconium, the balance being aluminum and incidental impurities;

b) homogenizing the workpiece at an elevated temperature;

c) cooling the workpiece;

d) heating the workpiece to an elevated temperature; and e) hot deforming the workpiece to form an aluminum alloy article having high corrosion resistance.

13. The process of claim 12 wherein the article is a tubing.

14. The process of claim 13 wherein the manganese ranges between about 0.3 and 1.0%, the magnesium ranges between about 0.2 and 0.6% and the zirconium ranges about 0.05 and 0.15%.

15. The process of claim 12 wherein copper is less than about 0.01%, titanium is between about 0.12 and 0.20%, zinc is between about 0.10 and 1.0% and iron is between about 0.05 and 0.30%.

16. The process of claim 12 wherein the aluminum alloy article is then cold deformed.

17. The process of claim 16 wherein the manganese ranges between about 0.3 and 1.0%, the magnesium ranges between about 0.2 and 0.6% and the zirconium ranges between about 0.05 and 0.15%.

18. The process of claim 12 wherein the aluminum alloy article is cold deformed and subsequently annealed.

19. The process of claim 18 wherein the manganese ranges between about 0.3 and 1.0%, the magnesium ranges between about 0.2 and 0.6% and the zirconium ranges between about 0.05 and 0.15%.

20. An article made by the method of claim 12.

21. An article made by the method of claim 16.

22. An article made by the method of claim 18.

23. The alloy of claim 1 wherein the amount of magnesium is at least 0.1 weight percent.

24. The alloy of claim 1 wherein the amount of zirconium is at least 0.05 weight percent.

25. The alloy of claim 1 wherein the amount of zinc is at least 0.10 weight percent.

26. The process of claim 12 wherein the workpiece has at least 0.1 weight percent of magnesium.

27. The process of claim 12 wherein the workpiece has at least 0.05 weight percent of zirconium.

28. The process of claim 12 wherein the workpiece has at least 0.10 weight percent of zinc.

* * * * *